US008979013B2

(12) United States Patent
Gambini

(10) Patent No.: US 8,979,013 B2
(45) Date of Patent: Mar. 17, 2015

(54) RAPID TEARING DEVICE OF A STRIP IN A REWINDING MACHINE

(75) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 199 days.

(21) Appl. No.: 13/527,295

(22) Filed: Jun. 19, 2012

(65) Prior Publication Data

US 2012/0318906 A1 Dec. 20, 2012

(51) Int. Cl.

| | |
|---|---|
| ***B65H 35/04*** | (2006.01) |
| ***B65H 19/22*** | (2006.01) |
| ***B65H 19/26*** | (2006.01) |

(52) U.S. Cl.

CPC ..... *B65H 19/2269* (2013.01); *B65H 19/267* (2013.01); *B65H 2301/41812* (2013.01); *B65H 2403/512* (2013.01)

USPC ..... 242/527; 242/527.2; 242/532.2; 242/532.3; 242/542

(58) Field of Classification Search

CPC .. B65H 19/2269; B65H 19/26; B65H 19/267; B65H 19/283; B65H 2408/235

USPC ..... 242/526, 532.2–532.3, 542, 527, 527.2

See application file for complete search history.

(56) References Cited

U.S. PATENT DOCUMENTS

| | | | | |
|---|---|---|---|---|
| 7,172,151 | B2 * | 2/2007 | Biagiotti et al. | 242/521 |
| 7,318,562 | B2 * | 1/2008 | Biagiotti et al. | 242/521 |
| 7,404,529 | B2 * | 7/2008 | Biagiotti et al. | 242/521 |
| 7,891,598 | B2 * | 2/2011 | Maddaleni et al. | 242/532 |
| 8,011,612 | B2 * | 9/2011 | Gelli et al. | 242/532.2 |
| 8,220,736 | B2 * | 7/2012 | Tsai | 242/532.2 |
| 8,302,900 | B2 * | 11/2012 | Gambini | 242/542 |
| 2005/0258298 | A1 | 11/2005 | Maddaleni | |
| 2009/0026299 | A1 * | 1/2009 | Tsai | 242/160.4 |

FOREIGN PATENT DOCUMENTS

| | | | |
|---|---|---|---|
| EP | 1923342 | A2 | 5/2008 |
| EP | 2213600 | A1 | 8/2010 |
| WO | 2004/005172 | A1 | 1/2004 |
| WO | 2004/096684 | A2 | 11/2004 |

OTHER PUBLICATIONS

Italian Search Report Dated Nov. 28, 2011.

* cited by examiner

*Primary Examiner* — Sang Kim

(74) *Attorney, Agent, or Firm* — Hedman & Costigan, P.C.; James V. Costigan; Kathleen A. Costigan

(57) ABSTRACT

A rapid tearing device of a strip in a rewinder for the winding of paper around a core (15) to produce a log (12), where said rewinder has a formation area of the log (12), for moving cores (15) forward into a channel (16) defined by a series of cradles (17) by an upper winding roller (18), the device having a blade (24), having the dimension of the width of the rollers (18, 19, 20), which can be moved by actuators (31, 35; 30, 22, 25) between a rest position and an engagement position on a core (15) when the core (15) is unloaded from said conveyor (13) by means of an introducer (34) and introduced into the channel (16) thus blocking, between core (15) and blade (24), the paper (11) which is being unwound.

6 Claims, 5 Drawing Sheets

RAPID TEARING DEVICE OF A STRIP IN A REWINDING MACHINE

The present invention relates to a rapid tearing device of a strip in a rewinding machine.

In the field of machines suitable for the formation of rolls or "logs" of paper destined for the preparation of toilet paper, blotting paper and/or similar products, rewinding machines are envisaged, which wind the continuous paper coming from a large paper roll, onto cores. For the production of paper rolls, in fact, there is a feeding of a continuous strip of paper material along a pre-defined route. It should be noted that the continuous strip, after starting its unwinding in a certain course, encounters a punching group whereby it is provided with transversal perforation lines to facilitate breakage and consequently the tearing of short sections of paper having a predetermined length.

The continuous strip therefore contains a series of transversal perforated weakening lines, parallel to each other and spaced at regular intervals.

The continuous strip thus treated, is introduced into the rewinding machine, where it is wound onto a cardboard supporting core, tubular in form, externally having a pre-determined portion of glue along a generatrix of the core.

The rotation of the core by means of a group of winding rolls causes the winding of the continuous strip until the respective roll or "log" of wrapping paper has been formed. As already mentioned, at the beginning of the winding, a piece of the strip is joined to the core by means of glue positioned on the latter.

At the end of the winding of a predetermined amount of continuous paper strip, the tail of the log must be separated thus contemporaneously creating the head of a new log to be formed.

The separation operation of the continuous strip is effected, for example, by means of tearing which causes the breakage of the continuous strip along one of the perforated lines produced on the paper and mentioned above.

This separation can be effected in various ways and using various devices. The tearing action of the continuous strip can be effected, for example, by varying the rotation rate of the winding rolls so as to create a section of strip sufficient for causing its breakage along a respective transversal perforated line.

Alternatively, in EP 1618057, the tearing of the continuous strip is effected by the high-pressure blowing of a fluid against the perforated line in order to cause its breakage.

Comb- or buffer-elements are also envisaged, which intervene on the strip near a perforation line and block the paper on the upper winding cylinder in order to effect the above-mentioned separation.

Even if the above systems and methods for the separation of the continuous strip of paper material allow the desired breakage of the paper to be effected along the transversal perforated line selected, these methods are either particularly complex or they generate folds on the paper and problems downstream during rewinding.

The general objective of the present invention is to solve the above-mentioned drawbacks of the known art in a simple, economical and particularly functional way.

Another objective of the invention is to provide device for the rapid tearing of a strip in a rewinding machine which does not cause folds on the paper which is being wound onto the core.

Yet another objective of the invention is to provide a device for the rapid tearing of a strip in a rewinding machine which causes the least possible waste of paper being wound before the paper adheres to the glue carried by the core.

A further objective of the present invention is to provide a device for the rapid tearing of a strip in a rewinding machine which does not use buffers or, in any case, does not exploit the combined action with the upper winding roll.

In view of the above objectives, according to the present invention, a device has been conceived for the rapid tearing of a strip in a rewinding machine having the characteristics indicated in the enclosed claims.

The structural and functional characteristics of the present invention and its advantages with respect to the known art will appear more evident from the following description referring to the enclosed drawings, which show, inter alia, a scheme of an embodiment of a rapid tearing device of a strip in a rewinding machine produced according to the same invention. In the drawings.

Figure 1:
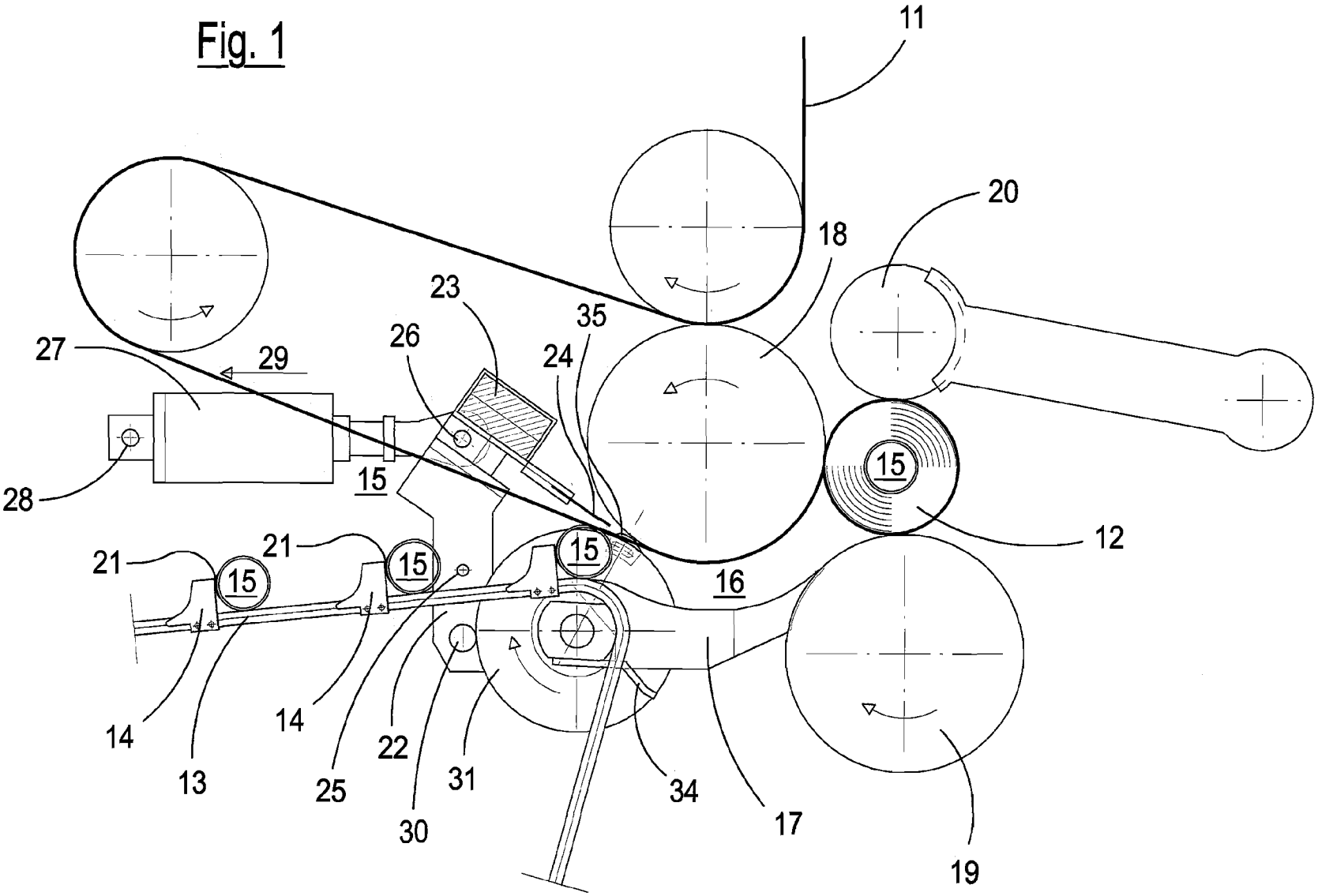
FIG. 1 shows a schematic and synthetic view of the main parts of a rewinding machine which comprises a rapid tearing device of a strip, according to the present invention.

With reference to FIG. 1, this substantially illustrates the core of a rewinding machine in which a rapid tearing device of a continuous strip of paper according to the invention, is positioned.

The rewinding machine at which a continuous strip of paper 11 arrives, such as, for example, toilet paper, blotting paper and/or other types of paper materials, essentially comprises an area in which the rolls or logs 12 of paper are prepared.

A conveyor 13 equipped with pushers 14 for the advancing of cores 15, made of cardboard for example, is positioned upstream of this area for the formation of the log.

The end of the conveyor 13 faces a channel 16 defined by a series of cradles 17 integral with the structure of the rewinder.

An upper winding roll 18 is positioned above the channel 16, or cradles 17, whereas a lower winding roll 19 is situated almost at the end of the cradles 17. A third oscillating roll 20 is positioned above the lower winding roll 19, cooperating with it and with the upper winding roll and acting as a press with a variation in the dimension of the log 12 being formed between the three mentioned rolls 18, 19 and 20.

The cores 15, carried by the conveyor 13 by means of the pushers 14, are previously provided with sections of glue 21, situated in correspondence with the area where the finger on a watch indicates nine. According to the present invention, a device according to the present invention is situated in a similar arrangement of the rewinder.

A pair of arms 22 are in fact envisaged, only one of which is shown, situated in opposite positions with respect to the ends of the rolls. The two arms 22 carry a cross-piece 23, for example tubular, on which a blade 24 is positioned, arranged transversally with respect to the advancing of the paper, which has the same size as the width of the mentioned rolls 18, 19 and 20 (size of the bench).

The blade 24 can be moved by means of actuators, between a stand-by position and an engagement position on a core 15, when this core 15 is discharged by the conveyor 13 and introduced into the channel 16 so as to block, between the core 15 and blade 24, the paper 11 which is being unwound and passing through this point.

The arms 22 oscillate around central pins 25 and two spring cylinders 27 are connected to these at a first end, in further pins 26, the spring cylinders 27 being hinged in turn at the other end of the arms by means of pins 28 to the structure of the rewinder.

The cylinders 27 act as elastic means and operate so that the arms are pulled back according to the arrow 29 of FIG. 1, i.e. moved away from the upper roll 18 so that the blade 24 does not interfere with one of the cores 15 pushed forwards by the pushers 14 of the conveyor 13, to be sent inside the channel 16. Furthermore, they normally keep the feelers 30 in contact with a cam wheel 31.

The device of the invention also envisages that the arms 22 oscillate by means of a cam wheel—movable feeler coupling in synchronism with a discharge introducer 34 of a core 15 from the conveyor 13 towards the channel 16.

More specifically, the cam wheel—movable feeler coupling envisages that a feeler 30 be positioned at the end of the oscillating arms 22, opposite to that where the blade 24 is situated. The feeler 30 is kept in contact with an outer surface of a cam wheel 31 positioned on the same axis 33 as a toothed wheel 32 which activates the movement of the conveyor 13. In this way the above-mentioned actuating means of the blade 24 are produced.

Furthermore, the cam wheel 31, or toothed wheel 32, carries at least one introducer 34 which discharges the core 15 carried by the pushers 14 of the conveyor 13 and introduces or inserts it at the inlet of channel 16.

A cam portion 35 radially protruding outwardly from the cam wheel 31, acts on the feeler 30 of the two arms 22 when a core 15 is introduced by the introducer 34 at the inlet of the channel 16.

Figure 3:
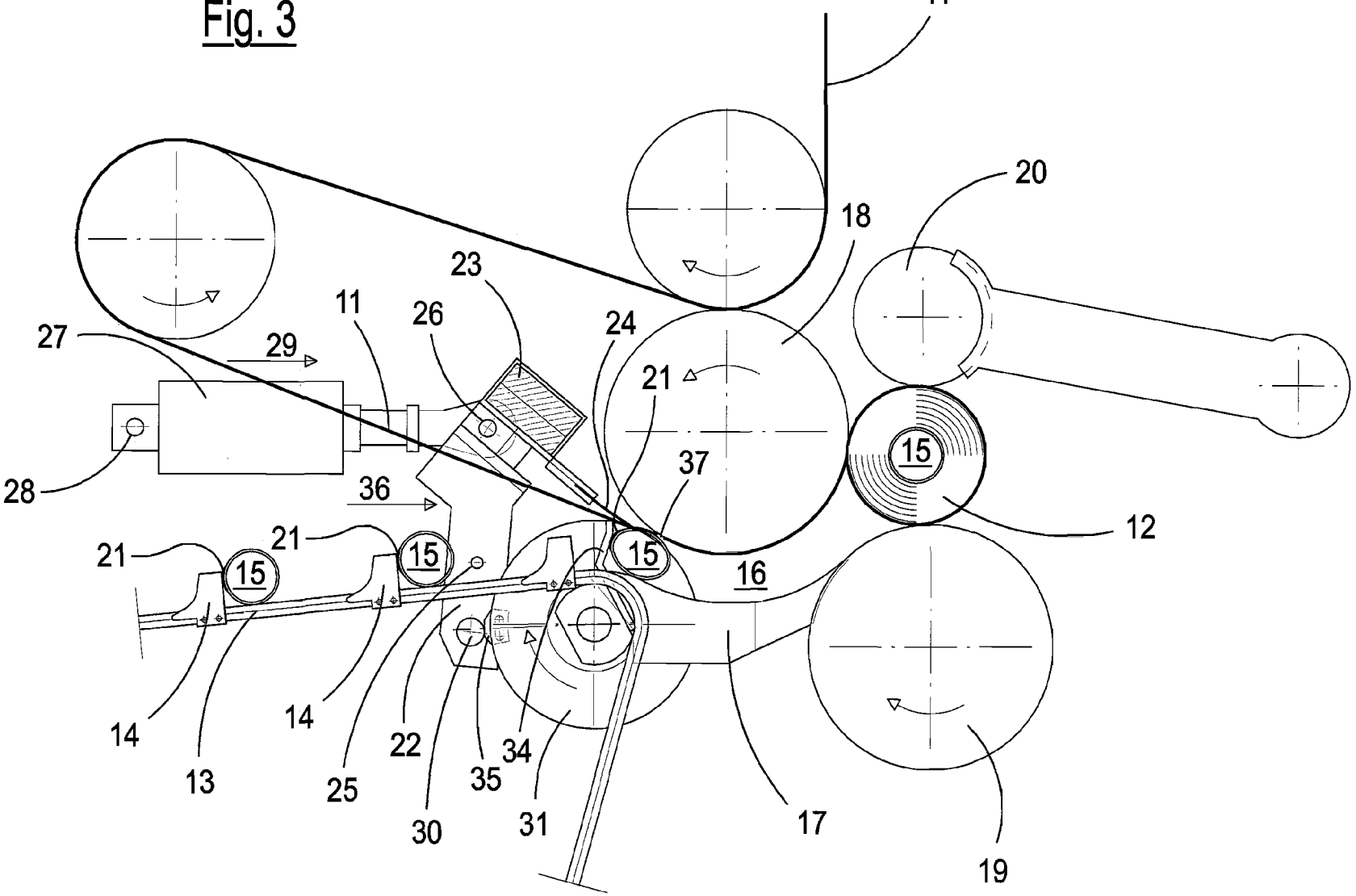
FIGS. 3 to 5 show, in similar views of FIG. 1, subsequent operative phases of the rapid tearing device of a strip in a rewinding machine according to the invention.

In this way, the arms 22 oscillate clockwise in FIG. 3, according to the arrow 36, overcoming the force of the spring cylinders 27 and the core 15 is pressed between the blade 24, the pusher 14 and the cradles 17 (FIG. 3).

In this way, the paper 11 is also pressed between the walls in contact with each other, and stops. The paper 11 is torn in the transversal perforated line 37, closest to the core 15, due to the strong deceleration it undergoes as a result of the pressure of the core 15 on the blade 24 which has stopped in the maximum proximity position towards the conveyor 13. In this way, the log 12, in formation, is freed and can be removed from its grip between the rolls 18, 19 and 20. In addition, the head of the paper is created, which will be wound around the core 15 which is thus introduced into the channel 16.

Figure 4:
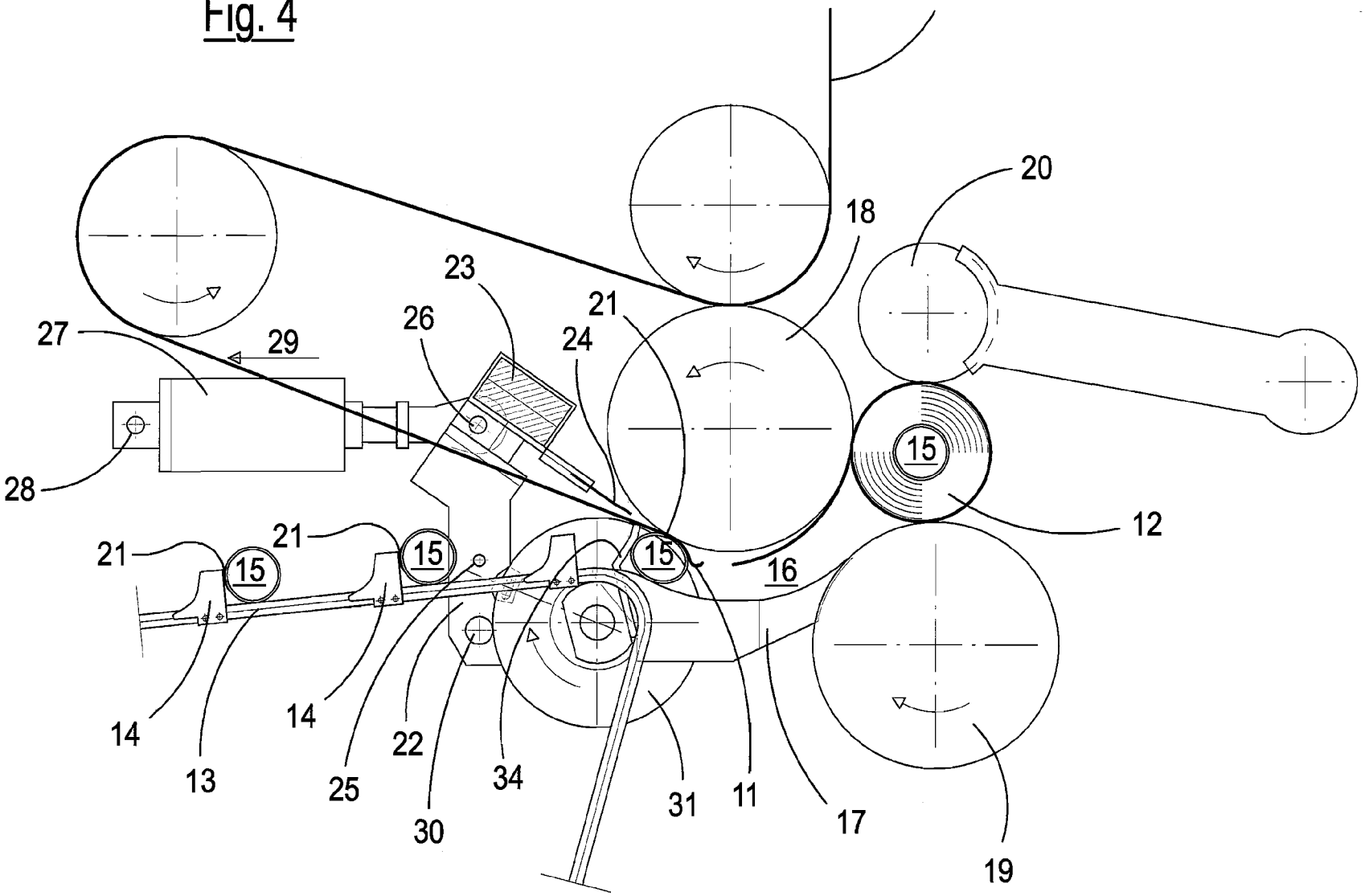

FIG. 4 shows how, by continuing the introduction of the core 15 into the channel 16 by means of the pusher 34, the lengths of glue 21, i.e. the glue, are put in contact with the paper 11 just before the head of the paper separated by the device of the invention.

Figure 5:
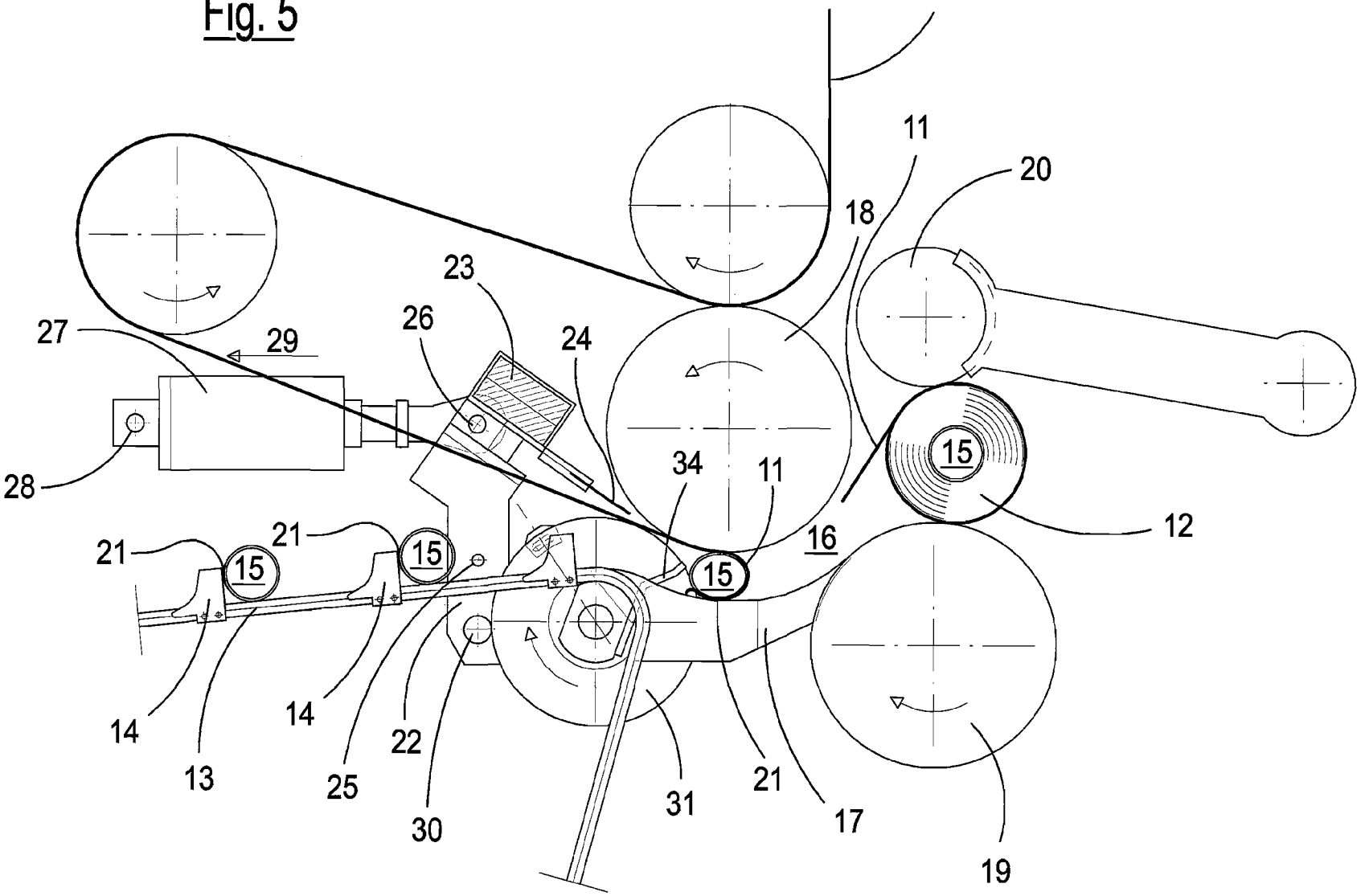

FIG. 5 shows a subsequent step, wherein the core 15, with the respective glued paper 11, is made to roll into the channel 16 by the action of the upper roll 18, to be positioned between the rolls 18, 19 and 20 of the rewinder to produce another log 12.

In the meantime, in an immediately subsequent step to that of the tearing shown in FIG. 3, the continuous rotation of the toothed wheel 32, or cam wheel 31, causes disengagement between the cam portion 35 of the cam wheel 31 and feeler 30 of the two arms 22, with backward oscillation of the same arms brought back by the cylinders 27 (FIG. 4).

The originality of this device consists in the fact that, as in previous devices, there is no specific device (a buffer, for example) which slows down the paper and tears it in the point closest to the perforation, acting on the upper winding roll. It is, in fact, the same core 15 which, in collaboration with the blade 24 situated near the paper 11, grips the paper and tears it.

The operative phases previously illustrated can be summarized by making reference to the figures.

FIG. 1 shows the rewinding machine and the device of the invention appears in stand-by, whereby the introducer 34 does not act and the blade 24 is raised, far from the cores 15 and from the paper 11.

Figure 2:
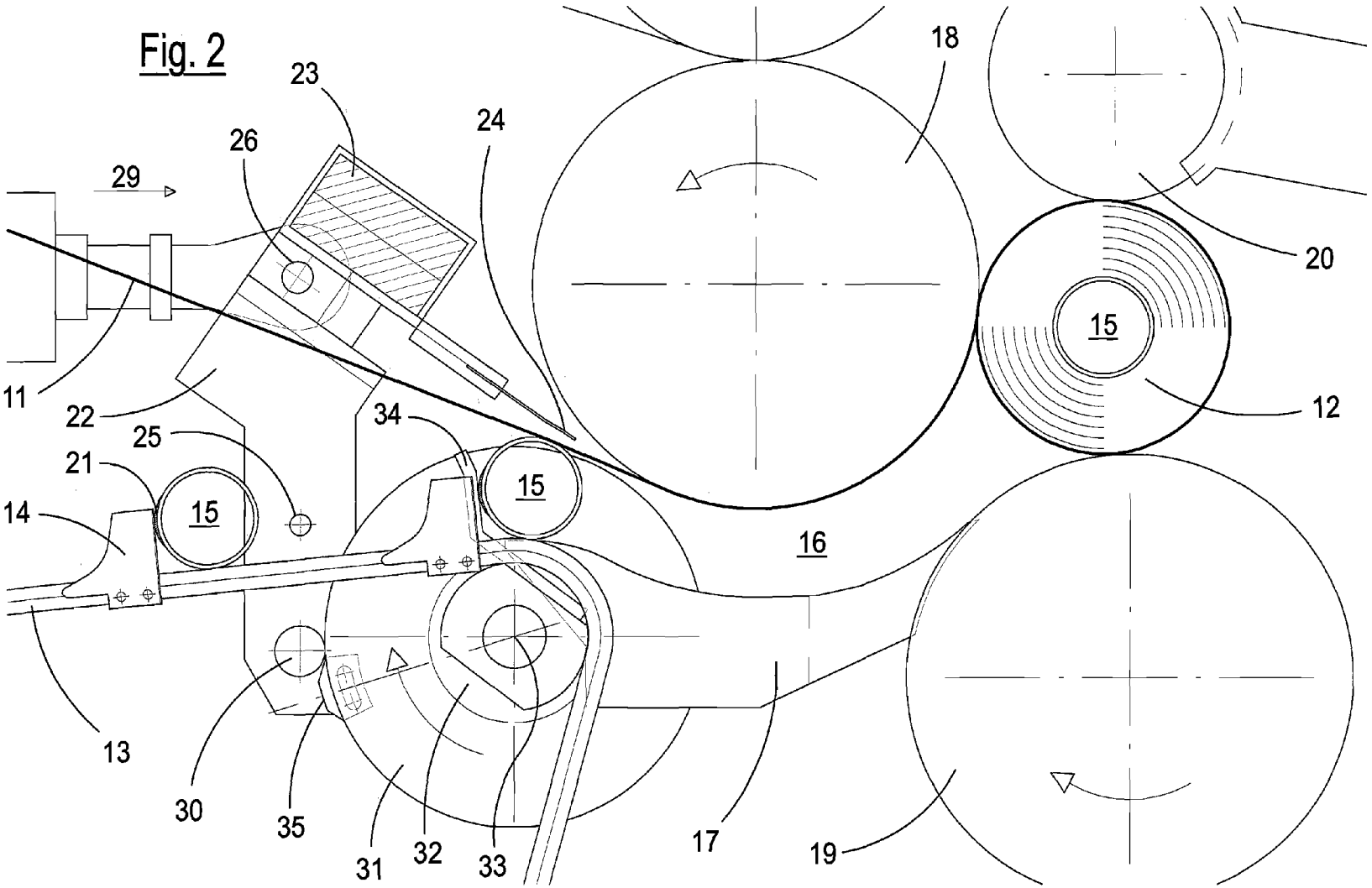
FIG. 2 is an enlarged detail of what is shown in FIG. 1, in a subsequent operative phase.

In FIG. 2, the core 15 is in an exchange phase, the introducer 34 is adjacent to it and the cam portion 35 of the cam wheel 31 is about to come into contact with the feeler 30 to make the arms 22 oscillate.

In FIG. 3, the introducer 34 is in movement and acts on the core 15, the cam portion 25 moves the arms 22 and causes the blade 24 to descend and block the paper 11 which is torn in the closest point to the perforation after the core 15.

In FIG. 4, the core 15 enters the cradles 17 and is rotated by the upper roll 18. In this way, the glue 21 is put, with the core, in contact with the paper 11 so as to form a new winding.

Finally, FIG. 5 illustrates more clearly how the log 12 formed between the rolls leaves the same and the wound core 15 is brought to the winding phase. It is also evident that the introducer 34 returns to the low disengagement position and another core 15 is moved forwards.

It can therefore be seen that the device of the invention is extremely simple and the capturing strip of the paper is extremely short and reduced to the minimum.

The objective mentioned in the preamble of the description has therefore been achieved.

The forms of the structure for the production of a device according to the invention, as also the materials and assembly modes, can obviously differ from those shown for purely illustrative and non-limiting purposes in the drawings.

The protection scope of the present invention is therefore delimited by the enclosed claims.

The invention claimed is:

1. A rapid tearing device of a strip in a rewinder for the winding of paper (11) around a core (15) to produce a log (12), wherein said rewinder essentially comprises a formation area of the log (12) upstream of which there is a conveyor (13) with pushers (14) for moving a core (15) forward into a channel (16) defined by a series of cradles (17) integral with the structure of said rewinder, and by an upper winding roller (18) which is situated above the channel (16), wherein the upper winding roller (18) collaborates with a lower winding roller (19) positioned almost at the final end of the cradles (17), whereas an oscillating roller (20) is situated above said lower winding roller (19) and acts as a press with the variation in the dimension of the log (12) being formed between said upper winding roller (18), said lower winding roller (19) and said oscillating roller, said device essentially consisting of a blade (24), having the dimension of the width of the rollers (18, 19, 20) is moved by actuators (31, 35, 30, 22, 25) between a rest position and an engagement position on said core (15) when said core (15) is unloaded from said conveyor (13) by means of a discharge introducer (34) and introduced into the channel (16) thus blocking, between said core (15) and blade (24), the paper (11) which is being unwound in order to tear said paper at a transversal perforation point (37) said blade (24) being positioned on an end of a pair of arms (22) hinged centrally on pins (25), said arms (22) being made to oscillate by means of a cam wheel (31) and a movable coupling feeler having a feeler (30) which move in synchronism with said discharge introducer (34) to discharge said core (15) from said conveyor (13) towards said channel (16).

2. The device according to claim 1, wherein in that said arms (22) carry said blade (24) at a first end and a feeler (30) at the other end, where said feeler (30) is kept in contact with said cam wheel (31) by elastic means (27).

3. The device according to claim 2, wherein in that said cam wheel (31) comprises a cam portion (35) protruding radially outwards.

4. The device according to claim 1, wherein said elastic means are spring cylinders (27).

5. The device according to claim 4, wherein in that said cam wheel (31) comprises a cam portion (35) protruding radially outwards.

6. The device according to claim 1, wherein in that said cam wheel (31) comprises a cam portion (35) protruding radially outwards.

* * * * *